US005662860A

United States Patent [19]

Klaassen et al.

[11] Patent Number: 5,662,860

[45] Date of Patent: Sep. 2, 1997

[54] APPARATUS FOR PRODUCING MOLTEN PIG IRON BY DIRECT REDUCTION

[75] Inventors: Antonius A. M. Klaassen, Santpoort-Noord; Hendrikus K. A. Meijer, Uitgeest, both of Netherlands

[73] Assignee: Hoogovens Staal B.V., Ijmuiden, Netherlands

[21] Appl. No.: 624,315

[22] Filed: Mar. 27, 1996

[30] Foreign Application Priority Data

Mar. 29, 1995 [NL] Netherlands ..... 9500600

[51] Int. Cl.[6] ..... C21B 7/22; C21B 11/00

[52] U.S. Cl. ..... 266/158; 266/182; 266/193; 75/453

[58] Field of Search ..... 266/158, 182, 266/190, 192, 193; 75/453

[56] References Cited

U.S. PATENT DOCUMENTS

| | | | |
|---|---|---|---|
| 3,462,263 | 8/1969 | Walsh et al. . | |
| 3,759,501 | 9/1973 | Foard | 266/182 |
| 4,076,954 | 2/1978 | Linder . | |
| 4,919,396 | 4/1990 | Fritsch et al. | 266/182 |

FOREIGN PATENT DOCUMENTS

| | | | |
|---|---|---|---|
| 0209149 | 1/1987 | European Pat. Off. . | |
| 2611876 | 9/1988 | France . | |
| 415469 | 10/1974 | U.S.S.R. | 266/193 |
| 2100755 | 4/1982 | United Kingdom . | |

OTHER PUBLICATIONS

*Single Vessel Smelting Reduction Using Cyclone Pre-Reducer,* Steel Times Int'l 17, No. 2, Redhill, Surrey, GB Mar. 1993.

*The Cyclone Converter Furnace,* Revue de Metallurgie 90 (1993) Mars, No. 3, Paris, FR.

*Primary Examiner*—Melvyn Andrews

*Attorney, Agent, or Firm*—Watson Cole Stevens Davis, P.L.L.C.

[57] ABSTRACT

Apparatus for producing molten pig iron by direct reduction of iron ore, comprises (i) a metallurgical vessel, in which with supply of coal and oxygen the iron ore undergoes a final reduction with production of a process gas and said process gas undergoes a partial post-combustion, and (ii) a melting cyclone in which the iron ore undergoes a pre-reduction and is melted. To improve the control of the thermal flows and to reduce maintenance, the vessel has (a) a top part, in which the partial post-combustion of said process gas takes place, in the form of a pressure-resistant hood having an interior wall comprising cooling water pipes, and (b) a bottom part for accommodating an iron bath having a slag layer in which said final reduction of said iron ore takes place, the bottom part having an internal refractory lining and means for water cooling the internal refractory lining.

11 Claims, 3 Drawing Sheets

APPARATUS FOR PRODUCING MOLTEN PIG IRON BY DIRECT REDUCTION

FIELD OF THE INVENTION

The invention relates to art apparatus for producing molten pig iron by direct reduction of iron ore, comprising a metallurgical vessel having means for supplying coal and oxygen thereto and in which the iron ore is finally reduced and a partial post-combustion of process gas takes place, and a melting cyclone in which the iron ore is pre-reduced and melted before transfer to the metallurgical vessel.

DESCRIPTION OF THE PRIOR ART

An apparatus of the above type is known from NL-C-257692. A description of the CCF (Cyclone Converter Furnace) process to be carried out in such an apparatus is published in Steel Times International, part 17, no. 3, March 1993, Redhill, Surrey, GB, page 24 "Single vessel melting reduction using cyclone pre-reducer". In the Dutch patent 257692 the apparatus was described in a somewhat elementary fashion. Since then the applicant has obtained new and fuller insight into this technology.

Other proposals for direct reduction of ore are to be found in U.S. Pat. No. 3,462,263, GB-A-2100755, U.S. Pat. No. 4,076,954 and EP-A-209149, but these in general do not give details of the furnace and of cooling required.

In the case of an apparatus for the CCF process, several problems need to be solved. First, the pre-reduced iron ore, FeO, is very corrosive especially in the area of the slag layer in the metallurgical vessel. Secondly the slag layer has the tendency to start foaming badly, causing great differences in the level of the slag layer and consequently of the process conditions. Thirdly the oxygen and the coal should be supplied in a manner which is optimal for the process.

SUMMARY OF THE INVENTION

The object of the invention is to provide an apparatus for the industrial application of the CCF process and which enables the process to be carried out with a low level of maintenance.

According to the present invention, the metallurgical vessel of the apparatus in accordance with the invention comprises:

(a) a top part, in which the partial post-combustion of the process gas takes place, in the form of a pressure-resistant hood having an interior wall (e.g. a water-cooled pipe wall) comprising cooling water pipes for cooling the interior wall, and (b) a bottom part for accommodating the iron bath having a slag layer in which the final reduction of the iron ore takes place, the bottom part having an internal refractory lining and means for water cooling the internal refractory lining.

The water-cooled refractory lining of the bottom part of the metallurgical vessel (converter) gives an acceptable service life, while the heat loss of the post-combustion in the top part of the metallurgical vessel is absorbed by the cooling pipes.

Preferably, the top and bottom parts of said metallurgical vessel have, adjacent a mutual connection zone, a larger horizontal internal cross-sectional area than at respective zones above and below the mutual connection zone, for accommodating the slag layer, which as mentioned may be voluminous. Thus the metallurgical vessel may be widest at the zone of the slag layer.

The top and bottom parts may be readily detachable. Thus the top part may have mounting means for holding it in its operational position, and the bottom part is detachable and removable from the top part which is held in its mounting means. Only the bottom part of the metallurgical vessel then has to be removed and if desired replaced. However, if the refractory lining of the bottom part has a sufficient life-time, this easy detachability of the bottom part from the top part is not required.

Preferably the melting cyclone is mounted directly above the metallurgical vessel and is in direct open communication therewith, the flow path from the melting cyclone to the metallurgical vessel in the downward direction being essentially without narrowing of the flow cross-sectional area. This creates a very simple apparatus without internal conveyance losses.

It is preferable for the water-cooled interior wall (pipe-wall) of the top part of the metallurgical vessel to be provided internally with a refractory sprayed coating. This protects the pipe-wall against any damage of a chemical, thermal and mechanical nature.

It is likewise preferable if the refractory lining of the bottom part of the metallurgical vessel consists of a permanent lining and a wear lining, and is provided with the water cooling at least in the zone of the slag layer. This blast furnace construction, while of itself well known, is a less usual construction for a converter, and prolongs the service life of the refractory lining at its most vulnerable point, i.e. in the zone of the slag layer.

In a preferred embodiment the means for supplying oxygen to the vessel consist of a central lance, i.e. a lance extending vertically at a central region of the vessel. This allows the oxygen always to be supplied to the metallurgical vessel at the same place above the slag layer even when the level of slag layer varies.

In another preferred embodiment the means for supplying oxygen consist of a plurality of lances projecting laterally through the wall of the metallurgical vessel and during operation reaching over the top of the slag layer. This avoids any disrupting action of a central lance on the process in the melting cyclone. Preferably these lances for supplying oxygen are oriented as much as possible vertically, i.e. extend obliquely downward. This achieves the effect that the supply of oxygen to the metallurgical vessel still takes place as much as possible in the same place above the slag layer as the level of the slag layer varies.

Preferably the means for supplying coal at least partly comprises at least one chute for lumps of coal, which projects through the wall of the top part of the metallurgical vessel. In accordance with present understanding, it is preferable for part of the coal to be supplied in the form of lumps and part in finely distributed or finely divided state. Consequently preferably the means for supplying coal comprises at least in part of at least one lance for supplying, coal in finely divided state with the aid of a carrier gas, which lance preferably projects through the wall of the metallurgical vessel, so that during operation the lance preferably reaches into the slag layer. This achieves the effect that the coal is directly absorbed into the slag layer, allowing the final reduction to run better.

Finely divided coal may be supplied via a lance using a carrier gas.

BRIEF INTRODUCTION OF THE DRAWINGS

Embodiments of the invention will now be described by way of non-limitative example, with reference to the accompanying drawings, in which.

DESCRIPTION OF THE PREFERRED EMBODIMENTS

Figure 1:
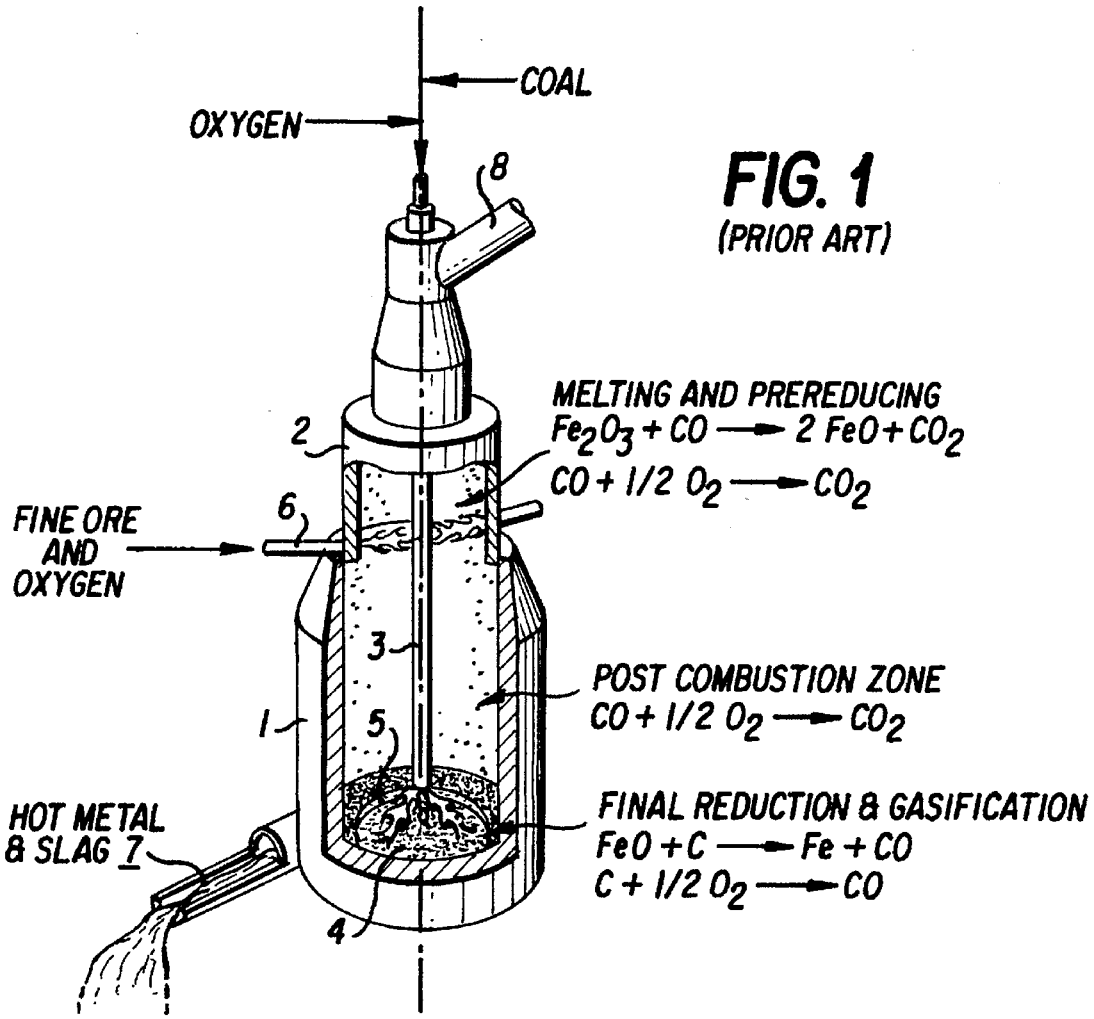
FIG. 1 (PRIOR ART)
FIG. 1 shows an apparatus for carrying out the CCF process in accordance with known prior art (the "Steel Times International" article described above).

The apparatus in FIG. 1 comprises a metallurgical vessel 1 of the converter type, a melting cyclone 2 and a central lance 3. The process is performed as follows. In the metallurgical vessel 1 there is an iron bath 4 with a slag layer 5 on top. Pre-reduced iron ore is finally reduced in the slag layer. To this end oxygen and coal are supplied to the metallurgical vessel 1 by means of the central vertical lance 3. In the final reduction a process gas comprising reducing CO is produced that is partially post-combusted above the slag layer 5 in the metallurgical vessel 1, whereby heat needed for the final reduction is released. The reducing process gas is further post-combusted in the melting cyclone 2 with oxygen supplied to the melting cyclone via inlet 6. Iron ore also supplied via inlet 6 is pre-reduced approximately to FeO and melted. The pre-reduced iron ore then falls or flows down into the metallurgical vessel 1. Pig iron and slag are tapped off via a tap hole 7. The process gas is discharged via an outlet 8. The process runs at a temperature ranging from 1500° C. to 1800° C. The pressure in the apparatus is in the range between 1 to 6 bars.

Figure 2:
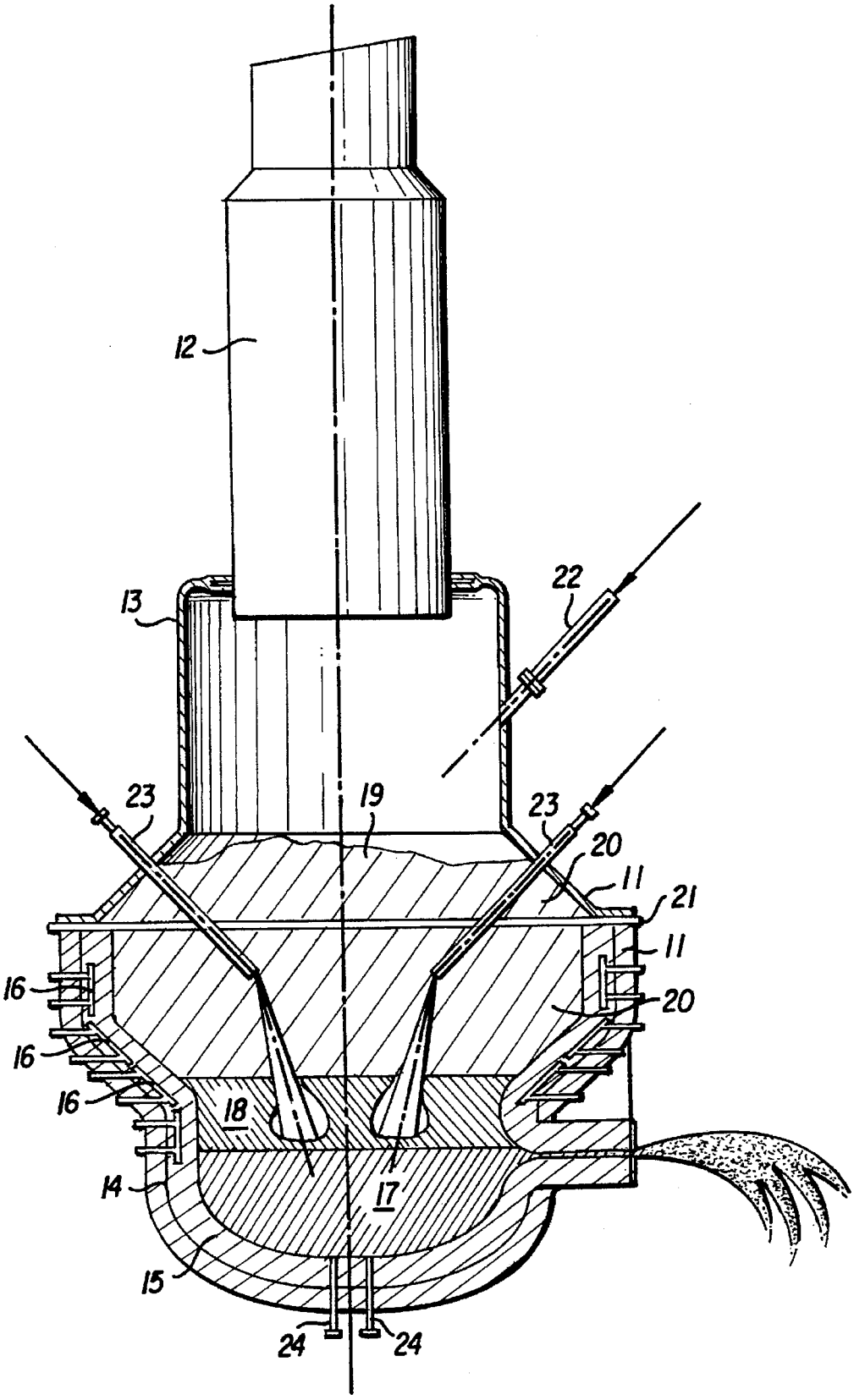
FIG. 2 shows a first embodiment of an apparatus in accordance with the invention for carrying out the CCF process on an industrial scale.

The apparatus of the invention shown in FIG. 2 performs the same process as that of FIG. 1, and need not be fully described again. The metallurgical vessel 11 comprises a top part 13 and a bottom part 14. The top part 13 is in the form of a pressure-resistant hood or cover with a water-cooled pipe-wall on its inside. The bottom part 14 is provided internally with a refractory lining 15 with water cooling 16. The water cooling 16 shown in FIG. 2 is of the stave cooler type well known in itself for cooling blast furnace brickwork. The cooling arrangement is positioned above the iron bath 17 in the zone of the slag 18, in particular in the zone of the foaming slag 19. FIG. 2 shows how, between its top and bottom ends, the metallurgical vessel 11 has a part 20 with an enlarged cross-section in which the foaming slag 19 is held. The metallurgical vessel 11 has a connection at 21 which permits the top part 13 to be released from the bottom part 14.

FIG. 2 shows coal being supplied by means of the chute 22 projecting through the wall of the top part 13 of the metallurgical vessel 11. Oxygen is supplied by means of the lances 23 which project laterally through the wall of the metallurgical vessel 11 and which during operation extend to above the slag layer 18. In principle, the part 20 with an enlarged cross-section makes it possible to position the lances 23 more vertically. FIG. 2 also shows how the iron melt 17 is being rinsed by gas 24 supplied through the bottom of the metallurgical vessel 11. The central lance 3 of FIG. 1 may also be employed in the apparatus of FIG. 2.

Figure 3:
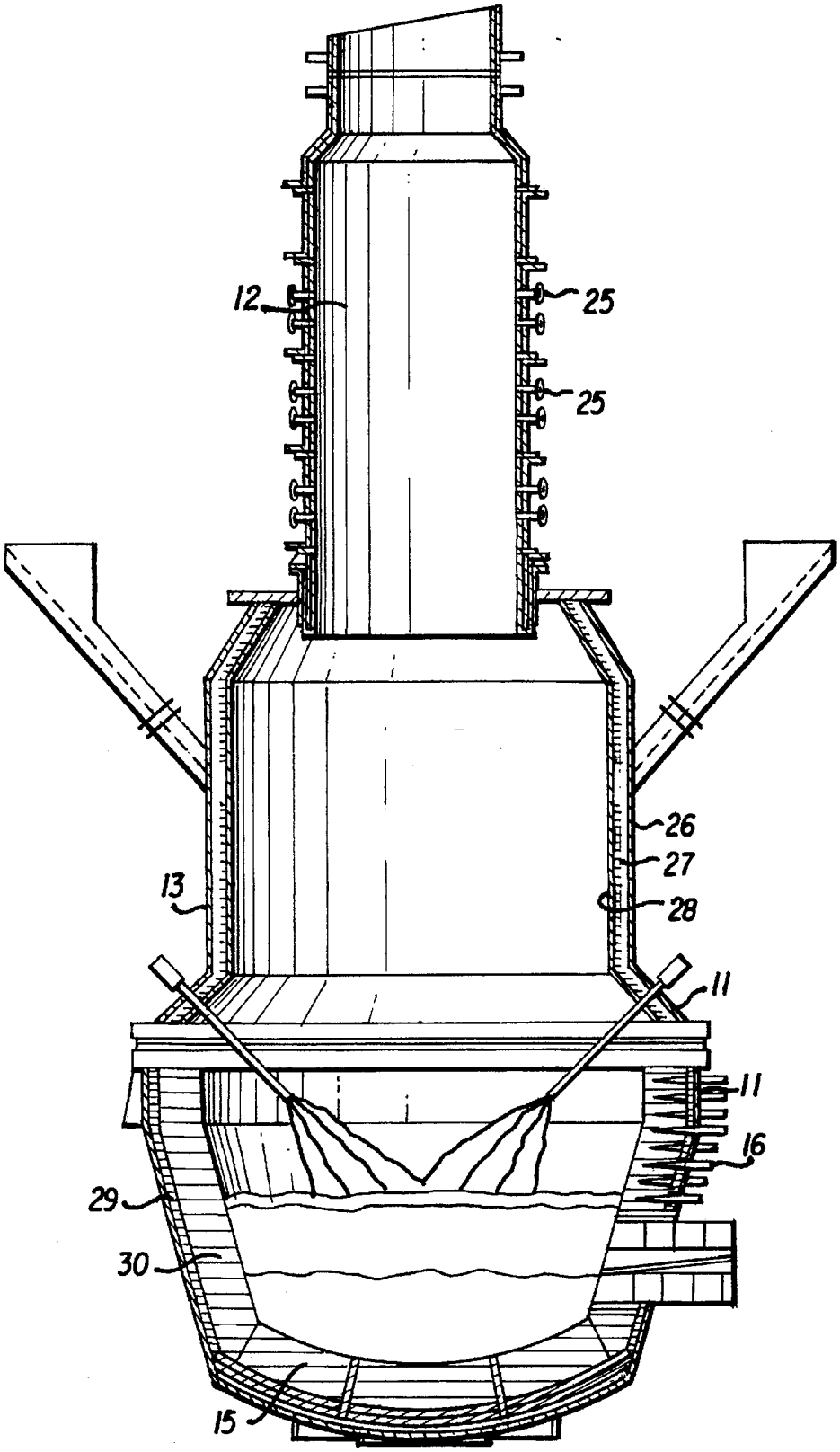
FIG. 3 shows a second embodiment of an apparatus in accordance with the invention.

FIG. 3 shows in specific aspects a more elaborated embodiment of the apparatus in accordance with the invention. It is similar to the apparatus of FIG. 2, and need not be fully described again. The melting cyclone 12 is shown to have a large number of connections 25 for the supply of iron ore and oxygen, which connections form an injection pattern enabling a high degree of pre-reduction of the iron ore to be achieved with a high collection yield in the melting cyclone. At the same time the figure shows how the melting cyclone is positioned directly above the metallurgical vessel 11 and in open connection with the metallurgical vessel 11 without any narrowing of the cross-section of flow in the downward direction. FIG. 3 also shows how the top part 13 comprises a pressure resistant hood 26, a water-cooled pipe-wall 27 and a refractory sprayed layer 28. The refractory lining 15 of the bottom part 14 of the metallurgical vessel 11 consists of a permanent lining 29 and a wear lining 30. In FIG. 3 the water cooling 16 is of the cooling plate type, which cooling arrangement is of itself known for blast furnace brickwork yet unusual for a converter.

Figure 4:
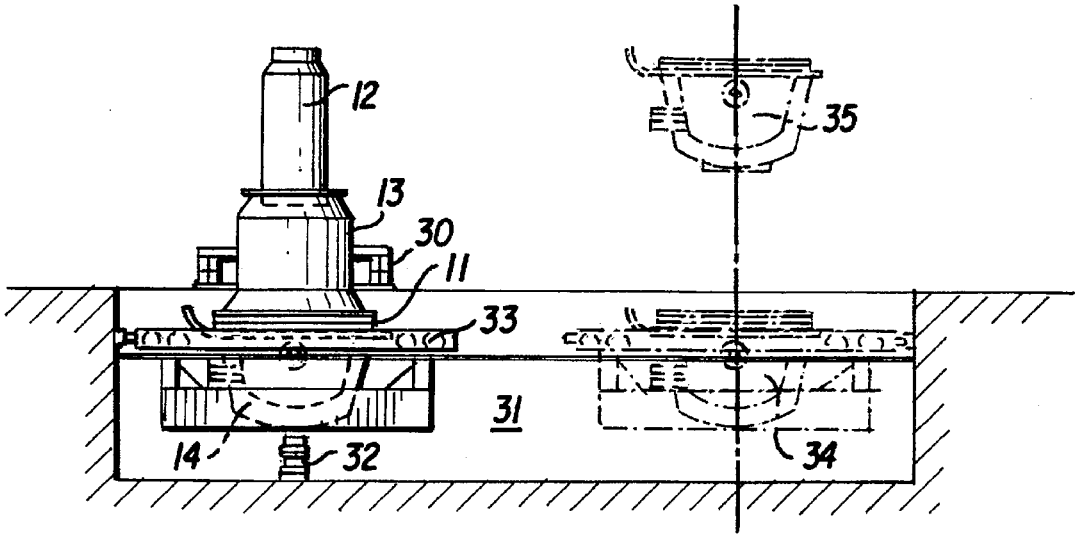
FIG. 4 shows the removal of the bottom part of the metallurgical vessel in the apparatus of FIG. 3.

FIG. 4 shows how the top part 13 of the metallurgical vessel 11 together with the melting cyclone 12 is fixed with the aid of a support 3 above a well 31. The bottom part 14 of the metallurgical vessel 11, having been released, can be removed by lowering it using a lift cylinder 32 and then using a carriage 33 taking it to position 34, whereupon the bottom part of the metallurgical vessel 14 may be taken away as shown at 35 for repair of the refractory lining. After this, if so desired, a second ready prepared version of the bottom part 14 may be fitted by the reverse sequence of steps.

While the invention has been illustrated by two embodiments, it is not restricted to them, and variations and modifications are possible within the scope of the inventive concept.

What is claimed is:

1. Apparatus for producing molten pig iron by direct reduction of iron ore, comprising (i) a metallurgical vessel, in which in operation of the apparatus the iron ore undergoes a final reduction with production of a process gas and said process gas undergoes a partial post-combustion, said metallurgical vessel having (a) a top part, in which said partial post-combustion of said process gas takes place, in the form of a pressure-resistant hood having an interior wall comprising cooling water pipes for cooling said interior wall, and (b) a bottom part for accommodating an iron bath having a slag layer in which said final reduction of said iron ore takes place, said bottom part having an internal refractory lining and means for water cooling said internal refractory lining, (ii) means for supplying coal to said metallurgical vessel, (iii) means for supplying oxygen to said metallurgical vessel, and (iv) a melting cyclone in which in operation of the apparatus said iron ore undergoes a pre-reduction and is melted, said melting cyclone being in communication with said metallurgical vessel for transfer of the pre-reduced iron ore thereto and for flow of the post-combusted process gas from the metallurgical vessel; wherein said top and bottom parts of said metallurgical vessel have, adjacent a mutual connection, a larger horizontal internal cross-sectional area than at respective areas above and below said mutual connection zone, for accommodating said slag layer.

2. Apparatus according to claim 1 wherein said top part of said metallurgical vessel has mounting means for holding it in its operational position, and said bottom part is detachable and removable from said top part held in said mounting means therefor.

3. Apparatus according to claim 1 wherein said melting cyclone is mounted directly above said metallurgical vessel and is in direct open communication therewith, the flow path from the melting cyclone to the metallurgical vessel in the downward direction being essentially without narrowing of the flow cross-sectional area.

4. Apparatus according to claim 1 wherein said interior wall of said top part of said metallurgical vessel is provided internally with a sprayed-on refractory coating.

5. Apparatus according to claim 1 wherein said internal refractory lining of said lower part of said metallurgical vessel comprises a permanent lining and a wear lining and said means for water cooling thereof is arranged to cool at least the zone thereof at which said slag layer is formed in operation.

6. Apparatus according to claim 1 wherein said means for supplying oxygen to said metallurgical vessel comprises a central oxygen lance.

7. Apparatus according to claim 1 wherein said means for supplying oxygen to said metallurgical vessel comprises a plurality of oxygen lances projecting laterally into the interior of the metallurgical vessel and extending over the top of said slag layer in operation.

8. Apparatus according to claim 7 wherein said oxygen lances extend obliquely downwardly to their discharge ends.

9. Apparatus according to claim 1 wherein said means for supplying coal to said metallurgical vessel comprises at least one chute for supplying coal in the form of lumps, projecting through said internal wall of said top part of said metallurgical vessel.

10. Apparatus according to claim 1 wherein said means for supplying coal to said metallurgical vessel comprises at least one coal lance for supplying finely divided coal and a carrier gas therefor.

11. Apparatus according to claim 10 wherein said coal lance extends into the zone of said slag layer in operation.

* * * * *